US006842179B2

(12) United States Patent
Emmot

(10) Patent No.: US 6,842,179 B2
(45) Date of Patent: Jan. 11, 2005

(54) GRAPHICS PROCESSING SYSTEM

(75) Inventor: Darel N Emmot, Ft Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 214 days.

(21) Appl. No.: 10/079,667

(22) Filed: Feb. 20, 2002

(65) Prior Publication Data

US 2003/0156115 A1 Aug. 21, 2003

(51) Int. Cl.[7] ..... G09G 5/39

(52) U.S. Cl. ..... 345/531; 345/537; 345/562; 345/547

(58) Field of Search ..... 345/531, 698, 345/3.3, 545, 547, 562, 564, 517, 544, 563, 537, 686, 556, 422, 571; 365/189.01; 382/305

(56) References Cited

U.S. PATENT DOCUMENTS 5,134,697 A * 7/1992 Scheffler ..... 711/171
6,052,126 A * 4/2000 Sakuraba et al. ..... 345/582
6,278,645 B1 * 8/2001 Buckelew et al. ..... 365/230.01
6,466,219 B1 * 10/2002 Shino ..... 345/531

* cited by examiner

*Primary Examiner*—Matthew C. Bella
*Assistant Examiner*—Hau Nguyen

(57) ABSTRACT

A system is provided for processing graphics data and outputting a stream of pixel data for display on an associated display device. The system is configured to store composed pixel data in a predetermined block of memory. The block of memory corresponds to a predetermined scan line of an associated display device.

25 Claims, 13 Drawing Sheets

PRIOR
ART

495

| ADD. | DATA | ADD. | DATA | ADD. | DATA | ADD. | DATA |
|---|---|---|---|---|---|---|---|
| 20010 | PIXEL 1 | 20120 | PIXEL 5 | 32450 | PIXEL 9 | 40590 | PIXEL 13 |
| 20011 | PIXEL 2 | 20121 | PIXEL 6 | 32451 | PIXEL 10 | 40591 | PIXEL 14 |
| 20012 | PIXEL 3 | 20122 | PIXEL 7 | 32452 | PIXEL 11 | 40592 | PIXEL 15 |
| 20013 | PIXEL 4 | 20123 | PIXEL 8 | 32453 | PIXEL 12 | 40593 | PIXEL 16 |
| 20014 | PIXEL 17 | 20124 | PIXEL 21 | 32454 | PIXEL 25 | 40594 | PIXEL 29 |
| 20015 | PIXEL 18 | 20125 | PIXEL 22 | 32455 | PIXEL 26 | 40595 | PIXEL 30 |
| 20016 | PIXEL 19 | 20126 | PIXEL 23 | 32456 | PIXEL 27 | 40596 | PIXEL 31 |
| 20017 | PIXEL 20 | 20127 | PIXEL 24 | 32457 | PIXEL 28 | 40597 | PIXEL 32 |
| 20018 | PIXEL 33 | 20128 | PIXEL 37 | 32458 | PIXEL 41 | 40598 | PIXEL 45 |
| 20019 | PIXEL 34 | 20129 | PIXEL 38 | 32459 | PIXEL 42 | 40599 | PIXEL 46 |
| 20020 | PIXEL 35 | 20130 | PIXEL 39 | 32460 | PIXEL 43 | 40600 | PIXEL 47 |
| 20021 | PIXEL 36 | 20131 | PIXEL 40 | 32461 | PIXEL 44 | 40601 | PIXEL 48 |
| 20022 | PIXEL 49 | 20132 | PIXEL 53 | 32462 | PIXEL 57 | 40602 | PIXEL 61 |
| 20023 | PIXEL 50 | 20133 | PIXEL 54 | 32463 | PIXEL 58 | 40603 | PIXEL 62 |
| 20024 | PIXEL 51 | 20134 | PIXEL 55 | 32464 | PIXEL 59 | 40604 | PIXEL 63 |
| 20025 | PIXEL 52 | 20135 | PIXEL 56 | 32465 | PIXEL 60 | 40605 | PIXEL 64 |
| Region A | | Region B | | Region C | | Region D | |

FIG. 6

GRAPHICS PROCESSING SYSTEM

TECHNICAL FIELD

The present invention is generally related to graphics processing and more particularly to a system and method for reducing bandwidth required to transfer pixel data for a pixel region in which the values of all pixel data in a given pixel region is equal to a predetermined reference pixel.

BACKGROUND OF THE INVENTION

In a typical computer graphics system a representation of a scene, that includes objects and/or environments having one or more surface areas, is generated and output for display on a display device. The surface areas would typically be divided into fixed sized regions and stored (cached) separately to help increase efficiency. These computer graphic systems typically incorporate processors configured to convert geometric data representing a surface area within a scene of interest, into pixel data that presents a two dimensional spatial representation of surface area. The pixel data is stored into memory and subsequently retrieved and processed to compose the pixel data. The composed pixel data is then output as a stream of pixels to an associated display device.

In a typical computer graphics system, a display device capable of displaying at a resolution of, for example, 16 pixels by 16 pixels will incorporate memory that is dedicated to storing pixel data that corresponds to a particular fixed region (pixel region) of the display area.

When pixel data is stored into memory, it is common to map available memory or a portion of available memory to correspond to a predetermined display device screen resolution. More particularly, for a display device capable of displaying a screen image at a predetermined number of horizontal pixels and a predetermined number of vertical pixels, memory is allocated to store data (pixel data) on a pixel-by-pixel basis. Pixel data is typically stored into memory as, for example, 8-bit data words, each 8-bit data word representing a single pixel. Typically one memory address is allocated for each pixel to be displayed on the corresponding display device.

Memory space for storing the pixel data is further allocated in blocks of sequential memory addresses (memory block) to correspond to predetermined regions of pixels of the display device. These memory blocks correspond to a predetermined burst size. This burst size may be determined by hardware requirements. Preferably, the burst size will be sufficient to enhance efficient pixel data transfer from/to memory. These regions of pixels are called pixels regions. For example, a display device capable of displaying imagery 16 pixels×16 pixels may be treated as a series of "pixel regions". Each pixel region may be, for example, 4 pixels horizontally and 4 pixels vertically.

FIG. 1 shows an example of a horizontally scanning display device 25 capable of displaying an image that is 16 pixels horizontally and 16 pixels vertically (i.e. 16 pixels×16 pixels). In this example, the display 25 is divided into a series of pixel regions (Reg. A, Reg. B, Reg. C, Reg. D., Reg. E, Reg. F, Reg. G, Reg. H, Reg. I, Reg. J, Reg. K, Reg. L, Reg. M, Reg. N, Reg. O and Reg. P). Each pixel region A-P contains a predetermined number of pixels. In this example, each pixel region A-P contains 16 pixels and is 4 pixels horizontally and 4 pixels vertically. It is recognized that 16 pixels by 16 pixels is not generally a realistic display screen resolution, however, for purposes of discussion herein limiting the resolution to a lower screen resolution such as 16 pixels×16 pixels allows for more clear illustration and discussion thereof. Those skilled in the art will recognize that most display devices operate at other, typically higher, resolutions.

FIG. 2 shows a further illustration of display 25. This illustration shows that display device 25 can be viewed as having a series of horizontal scan lines (SCAN LINE 1 through SCAN LINE 16). Each of these horizontal scan lines includes a series of sequential pixels. These horizontal scan lines are one pixel vertically and sixteen pixels horizontally. SCAN LINE 1 includes pixels 1 through 16. Similarly, SCAN LINE 2 through SCAN LINE 16 include pixels 17 through 256. SCAN LINE 15 includes pixels 225 through 240. SCAN LINE 16 includes pixels 241 through 256.

For each pixel region A-P, a block of sequential memory addresses in memory is reserved for storing pixel data. Each block of sequential memory addresses corresponds to a particular pixel region. Pixel data for each pixel within the particular pixel region is stored into the corresponding block of sequential memory addresses.

FIGS. 3A and 3B illustrate how pixel data for given pixels regions of a display device 25 may be stored into memory. Here portions of memory 120 have been allocated to store pixel data for each pixel region A-D. It will be recognized that memory should also be allocated to store pixel data for the pixel regions E–P, however, for purposes of illustration, FIG. 3A shows that memory has been allocated only for pixel regions A, B, C and D.

It can be seen that memory addresses 20010 through 20025 have been allocated to store pixel data related to the pixels of pixel region A (pixel 1, 2, 3, 4, 17, 18, 19, 20, 33, 34, 35, 36, 49, 50, 51 and 52). Similarly, memory addresses have been allocated to store pixel data related to the pixels of pixel regions B, C and D. The typical computer graphic system is configured to retrieve pixel data from memory in bursts by blocks of a predetermined size. This predetermined size may correspond to the size of the blocks of sequential memory addresses in which pixel data for pixels regions is stored. The retrieved block of pixel data is then composed and the composed pixel data is output to an associated display device as a stream of pixel data.

A typical display device displays an image by scanning a series of scan lines, one scan line at a time, until all image data has been displayed. A scan line is composed of a series of either horizontally or vertically adjacent pixels. A typical display will scan lines either horizontally or vertically. In order to scan a scan line, the display must be provided with a stream of pixel data corresponding to the scan line to be displayed. For a horizontally scanning display capable of displaying a screen image and resolution of, for example, 16 pixels×16 pixels, one horizontal scan line represents a vertical dimension of one pixel and a horizontal dimension of 16 pixels. (Note: It is recognized that 16 pixels by 16 pixels is not generally a realistic display screen resolution, however, for purposes of discussion herein limiting the resolution to a lower screen resolution such as 16 pixels×16 pixels allows for more clear illustration and discussion thereof.)

The display 25 is composed of a series of a horizontal scan lines each consisting of 16 horizontal pixels. For example, the first horizontal scan line on display 25 includes sixteen pixels numbered 1 through 16. Similarly the last (or bottom) horizontal scan line is composed of sixteen pixels, numbered 241 through 256. During display of an image, pixel data is retrieved from the memory and output so as to provide a stream of pixel data to an associated display 25, one horizontal scan line at a time.

FIG. 3B illustrates the sequence in which pixel data is retrieved from a typical computer graphics system. In order to provide a stream of pixel data to display 25 (FIG. 1) to display, for example, the horizontal scan line (FIG. 3A) composed of the pixels 1–16, all pixel data corresponding to the pixel regions A, B, C & D must first be retrieved. This data is retrieved during each cycle of refreshing the display 25. Only four (4) pixels from each pixel region are necessary to display the first scan line. More particularly, pixels 1, 2, 3 and 4 are needed from pixel region A; pixels 5, 6, 7 & 8 are needed from pixel region B; pixels 9, 10, 11 & 12 are needed from pixel region C; and pixels 13, 14, 15 & 16 are needed from pixel region B. The arrows "R" are used to indicate the sequence in which pixel data is retrieved from memory 120. The typical computer graphics system does not retrieve only the needed pixel data (pixels 1–16) due to the way pixel data is stored into memory and the manner in which pixel data is retrieved from memory in data transfer burst of a given size. Instead, entire blocks of pixel data corresponding to the pixel regions A, B, C & D (in this example, a total of 64 pixels worth of pixel data) must be retrieved and any un-needed pixel data is then discarded. Only the needed pixel data is output to the display as a stream of pixel data (i.e., any pixel data other than pixel data for pixels 1–16 is discarded). This is a very inefficient use of resources as a great deal of processing bandwidth is consumed with retrieving and discarding unneeded pixel data.

Further, during each refresh cycle, the pixel data stored to memory 120 will be retrieved and composed, regardless of whether or not new pixel data has been written into the memory 120 since the last refresh cycle. As a result, resources are wasted composing pixel data that has not changed and will not yield any different composed pixel data.

Thus, a heretofore unaddressed need exists in the industry to address the aforementioned deficiencies and inadequacies.

SUMMARY OF THE INVENTION

The present invention provides a system and method for efficient use of memory bandwidth in processing pixel data corresponding to a given pixel region in which pixel values within the pixel region are constant. Briefly described, in architecture, the system can be implemented as follows. A controller is provided that is configured to identify pixel data associated with a predetermined pixel region to be stored to memory and to associate a predetermined reference pixel with the pixel region. The controller is further configured to set a fill check bit associated with the pixel region to indicate when the values of all pixels within the pixel region are the same as a predetermined reference pixel data. Further the controller is configured to store pixel data for the reference pixel to memory and to set a fill check bit associated with the pixel region where the values of all pixels within the pixel region are the same as the predetermined reference pixel data The present invention can also be viewed as providing a method for processing pixel data corresponding to a given pixel region in which pixel values within the pixel region are constant. In this regard, the method can be broadly summarized by the following steps: Pixel data associated with a predetermined pixel region to be stored to memory is identified. A predetermined reference pixel is associated with the pixel region. Pixel data for the reference pixel is stored to memory; and, where true, a fill check bit associated with the pixel region is set to indicate that the values of all pixels within the pixel region are the same as the predetermined reference pixel.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 6 is a block diagram illustrating an embodiment of how pixel data is stored to blocks of sequential memory addresses that are associated with a predetermined pixel region;

DETAILED DESCRIPTION

One aspect of the invention provides a system for composing pixel data in which composed pixel data is stored to memory in blocks of sequential memory addresses that correspond directly to a scan line, or a portion of a scan line, of an associated display device. More particularly, for a given scan line, a block of sequential memory addresses will contain only values for sequential pixels that make up the current scan line. Each block of sequential memory addresses will preferably correspond to a predetermined data transfer burst size. Thus, when composed pixel data is read from a block of sequential memory addresses during a data transfer burst, the sequential memory addresses will contain values for sequential pixels of a scan line currently being written. In this way, values for composed pixels within other scan lines that are not currently being written will not be retrieved during a data transfer burst. Thus all composed pixel data read out of a block of sequential memory addresses during a data transfer burst will be relevant to the current scan line currently being written.

In the following discussions, horizontal scan lines are discussed. It will be understood however, that the discussions are equally applicable to vertical scan lines.

Figure 4:
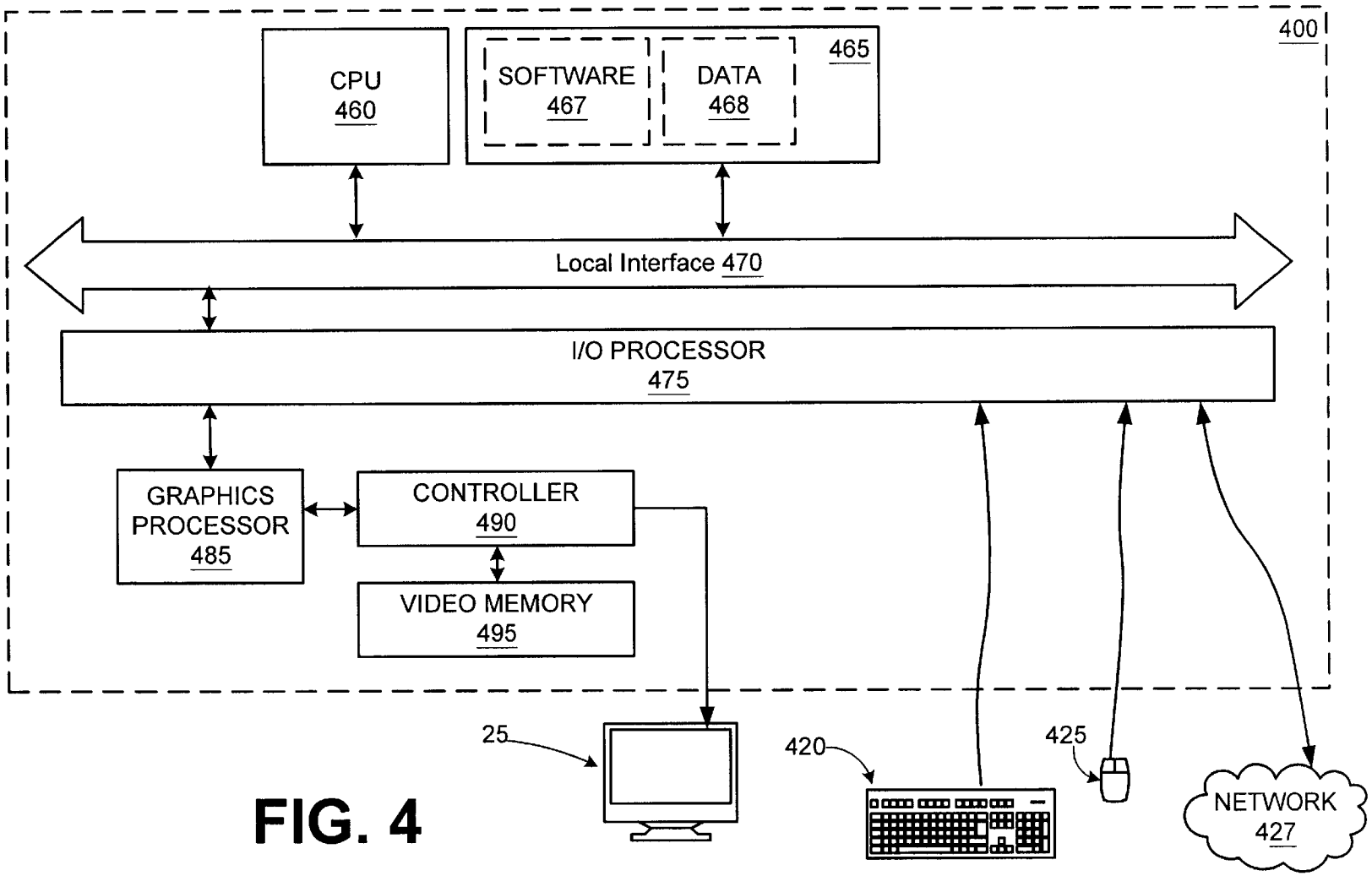
FIG. 4 is a block diagram of an embodiment of a graphics system according to the invention.

FIG. 4 is a block diagram of an embodiment of a graphics system 400 according to the present invention. This embodiment includes a central processing unit 460, storage memory 465 for storing data 468 and/or software 467. An input/output (I/O) processor 475 is provided for interfacing with associated input and output devices. A local interface 470 is provided for transferring data between the CPU 460, memory 465 and/or I/O processor 475. A processor 485 is provided for processing graphics data. Further there is video memory 495 and a controller 490. Controller 490 may be configured to provide data to display device 25. Display device 25 may be either a horizontally scanning device or a vertically scanning device. It will be noted that the discussions herein address a horizontally scanning display device, however it will be recognized that the discussion herein are equally applicable to a vertically scanning display device. Associated input and output devices may include keyboard device 420, mouse/pointing device 425 and/or a network 427. Network 427 may be a local area network (LAN) or a wide area network (WAN) such as, for example, the Internet.

CPU 460 is preferably configured to operate in accordance with software 467 stored on memory 465. CPU 460 is preferably configured to control the operation of system 400 so that geometric data representing a surface area, or object within a scene to be displayed on an associated display device 25, will be converted to pixel data, composed and output to an associated display device 25. CPU 460 may also be configured to control the transfer of data, such as geometric data, to the processor 485 via the I/O processor 475. For example, processor 485 may be configured to convert geometric data representing, for example, a rectangular region of pixels having a constant data value, into pixel data representative of the rectangular region of pixels as illustrated in FIG. 6. These regions of pixels are stored in memory 495 via processor 485 via controller 490.

Controller 490 takes pixel data composes it and then stores the composed pixel data back into memory 495.

Composed pixel data is stored into memory 495 in blocks of sequential memory addresses. Each block of sequential memory addresses corresponds to a predetermined horizontal scan line of an associated display device 25. FIG. 7, discussed below, illustrates how composed pixel data is stored to memory 495 in blocks of sequential memory addresses that are associated with a predetermined scan line or portion of a scan line, of a display device.

Controller 490 controls the output of composed pixel data of FIG. 7 to an associated display device 25. Composed pixel data is retrieved from blocks of sequential memory addresses and output as a stream of composed pixel data to an associated display device 25. This stream of composed pixel data corresponds to predetermined horizontal scan lines of the associated display device 25.

Figure 5:
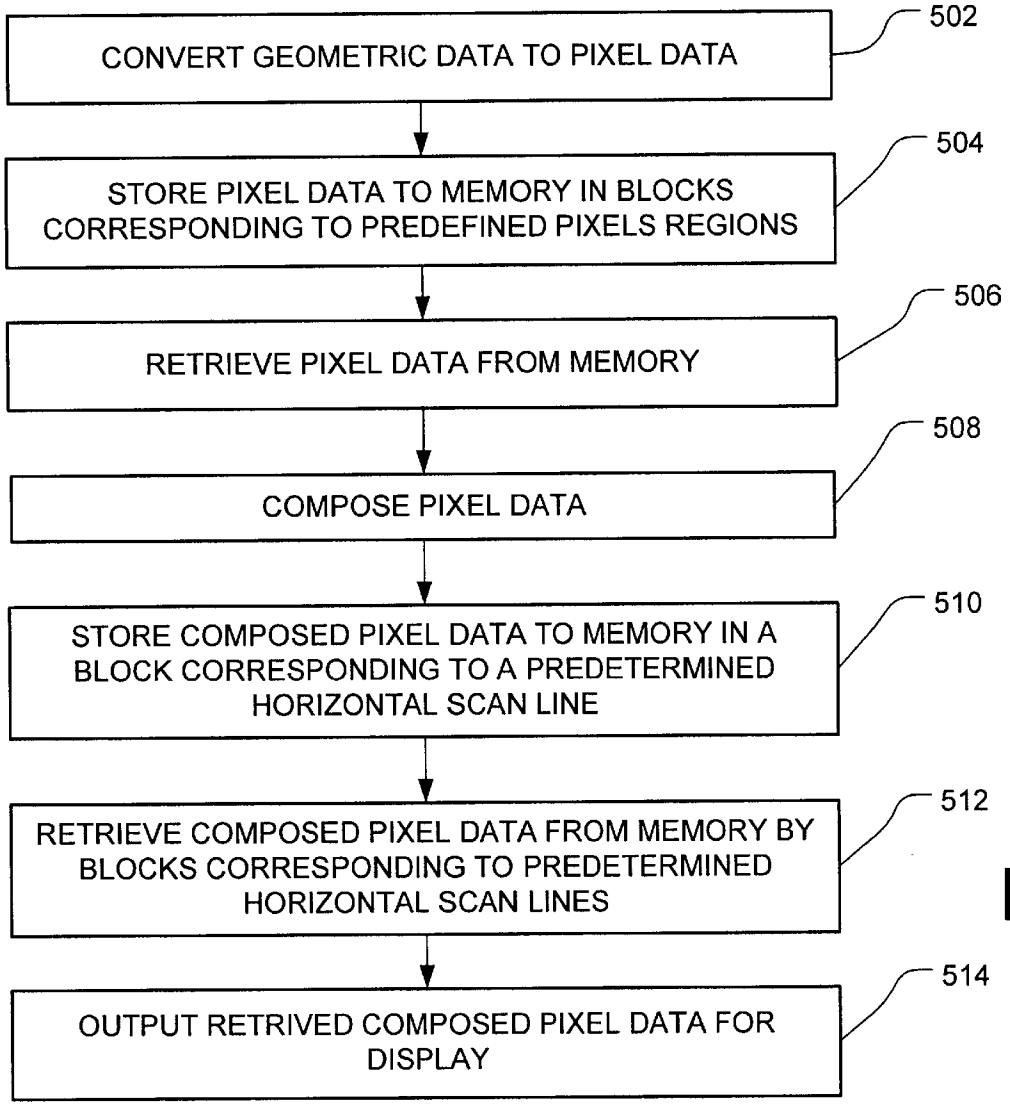
FIG. 5 is a flowchart illustrating an embodiment of the process of storing pixel data to memory according to the invention.

FIG. 5 is a flowchart illustrating a method of composing pixel data for output to a display device. Geometric data is received and converted into pixel data (502). In one embodiment, processor 485 of system 400 discussed above may be configured to convert geometric data into pixel data representative of a surface area within a scene to be displayed on an associated display device 25. The resulting pixel data is stored into memory in blocks of sequential memory addresses (blocks) (504). Each of these blocks of sequential memory addresses preferably corresponds to a predefined pixel region, or a portion of a pixel region, of an associated display device 25 (FIG. 4). The size of the block of sequential memory addresses may be selected to correspond with a predetermined data transfer burst size. For example, in one embodiment, the data transfer burst size of controller 490 may be used to determine the size of each block of sequential memory addresses. FIG. 6, discussed below, illustrates the storage of pixel data to a sequential block of memory addresses prior to composition. Each sequential block of memory addresses is associated with a predetermined pixel region of a display device.

Figure 7A:
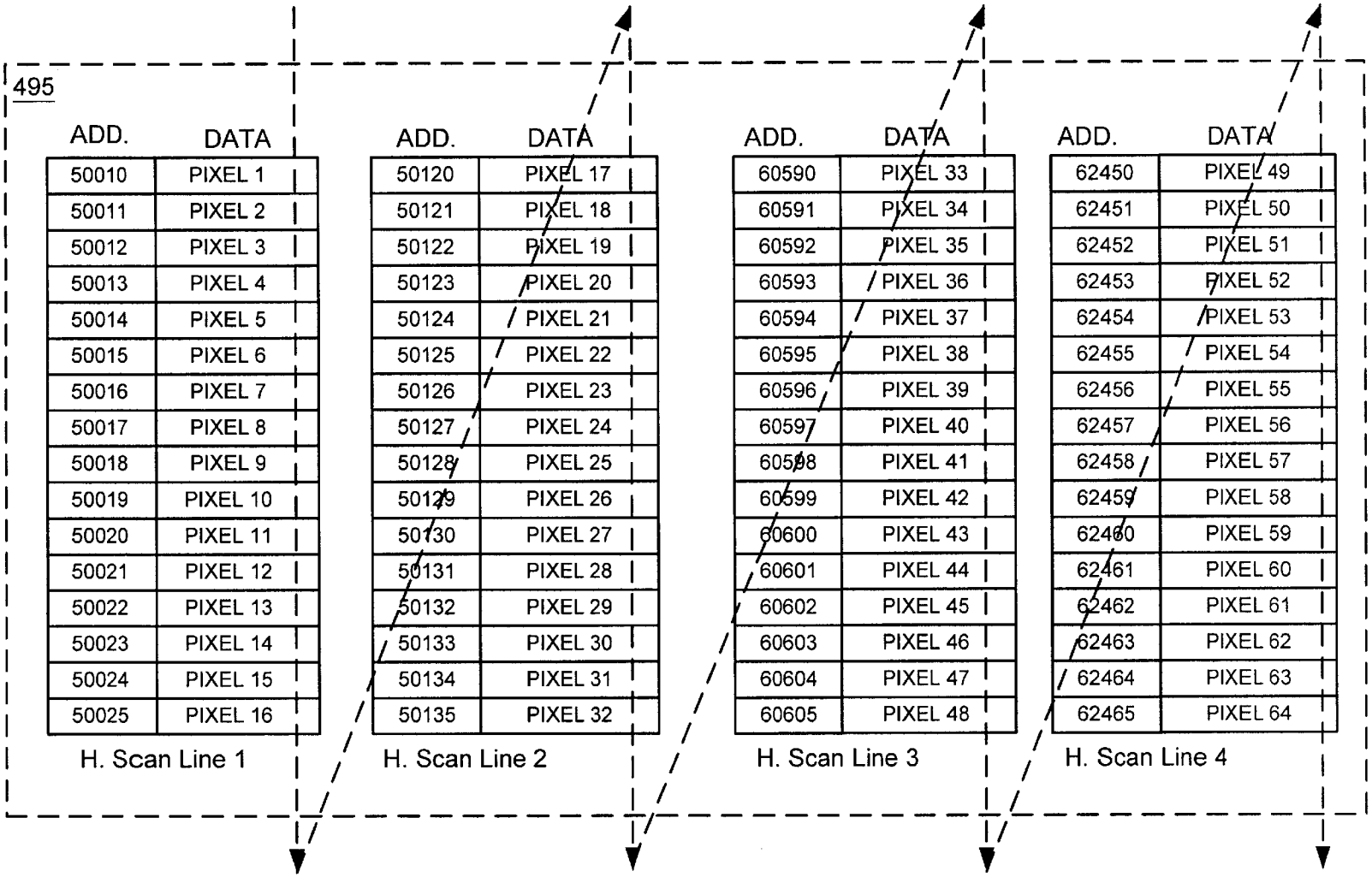
FIG. 7A is a block diagram illustrating an embodiment of how composed pixel data is stored to memory in blocks of sequential memory addresses.
Figure 7B:
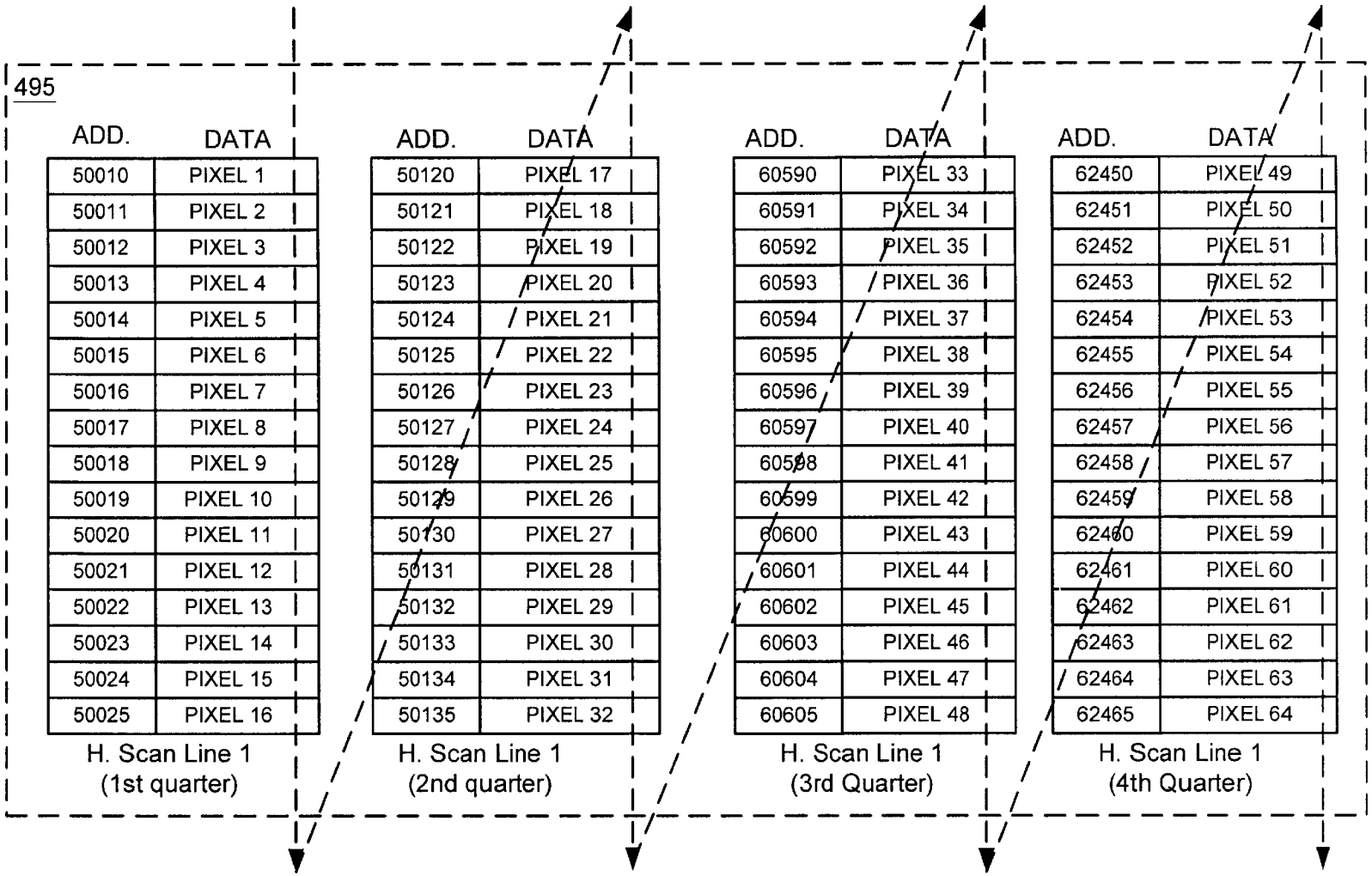
FIG. 7B is a further diagram illustrating an embodiment of how composed pixel data is retrieved from memory in blocks of sequential memory addresses.

Pixel data is then retrieved from the block of sequential memory addresses (506) into which it was stored. The retrieved pixel data is then composed to produce composed pixel data (508). In another embodiment, controller 490 is further configured to have pixel data retrieved from memory 495 and compose the pixel data to generate composed pixel data. This composed pixel data represents surface areas or objects of a scene to be displayed. The composed pixel data is stored into memory in blocks of sequential memory addresses (510) that correspond to a predetermined scan line, or a contiguous portion of a scan line, of an associated display device. This block of sequential memory addresses is preferably a second block of memory addresses separate from the block of sequential memory addresses into which pixel data was stored at step 504. FIGS. 7A and 7B, discussed below, illustrate the storage of composed pixel data to a sequential block of memory addresses that is associated with a predetermined scan line, or portion of a scan line, of an associated display device.

Composed pixel data is retrieved from memory (512) and is output for display on an associated display device by controller 490. More particularly, composed pixel data for a scan line, or portion of a scan line, of an associated display device will be retrieved from a block of sequential memory addresses in which it is stored. Each sequential memory address contains composed pixel data for a pixel of a predetermined scan line. The pixel data will be read out of the block of sequential memory addresses and then output to the display device thereby causing either a scan line or portion of a scan line to be drawn on the display device. Pixel data may be output to the display device in a complete data transfer burst, or may be read out in sequence, one memory address at a time. It will be noted that the blocks of memory addresses do not have to be stored into a single memory device or that the blocks be stored in sequential order within a memory device.

FIG. 6 illustrates four blocks of sequential memory addresses in memory 495. Each of these blocks of sequential memory addresses corresponds to a predetermined pixel region of the associated display device 25. These blocks of sequential memory addresses may be said to represent an image surface. While only four blocks of memory are illustrated, it will be recognized that a block of memory sequential addresses may be allocated for each respective pixel region of an associated display device 25, thus, in the case of the associated display device 25 shown in FIG. 1, sixteen blocks of sequential memory addresses could be allocated to provide for full coverage of pixel data for the display.

As noted above with regard to FIG. 5, the controller 490 is maybe configured to store pixel data into memory 595.

This pixel data is stored to memory 495 in blocks of sequential memory addresses. In this example, the block of sequential memory addresses 20010 through 20025 corresponds to pixel Region A of associated display device 25 (see FIG. 1). It can be seen that the block of memory addresses corresponding to region A is allocated to store pixel data for the pixels 1, 2, 3, 4, 17, 18, 19, 20, 33, 34, 35, 36, 49, 50, 51 and 52. Similarly, blocks of sequential memory addresses are allocated for each of pixel Regions B, C and D. As can be seen, the pixels stored in each of the above noted blocks of memory are not sequential and do not correspond to a single horizontal scan line of an associated display device 25.

FIGS. 7A and 7B illustrate four blocks of sequential memory addresses in memory 495. Each of these blocks of sequential memory addresses stored composed pixel data and can therefore be said to represent a composed surface. Each of these blocks of sequential memory addresses corresponds to a predetermined scan line, or a contiguous portion of a scan line, of an associated display device 25.

Figure 1:
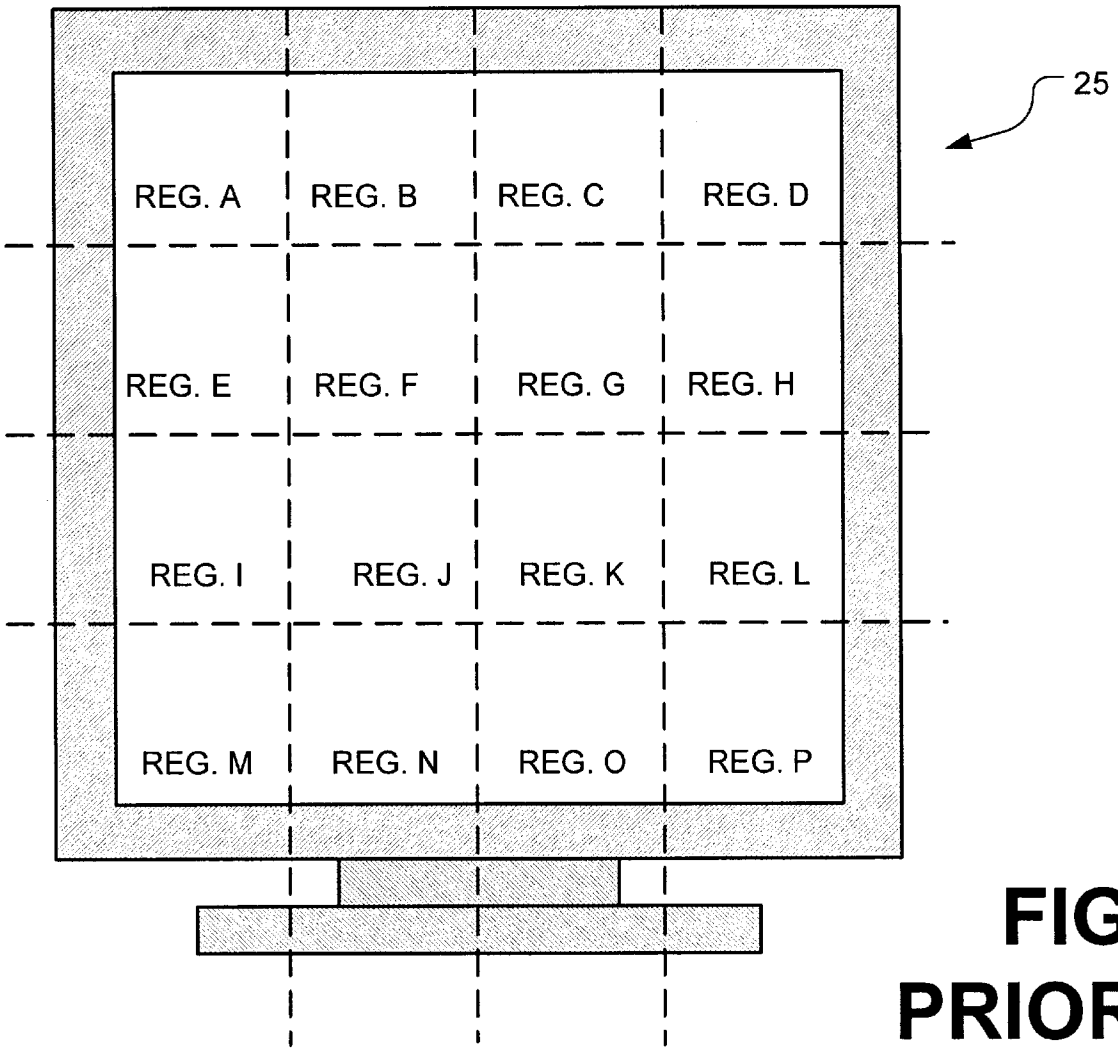
FIG. 1 PRIOR ART
FIG. 1 is a diagram illustrating predefined pixel regions of a corresponding display device 25.
Figure 2:
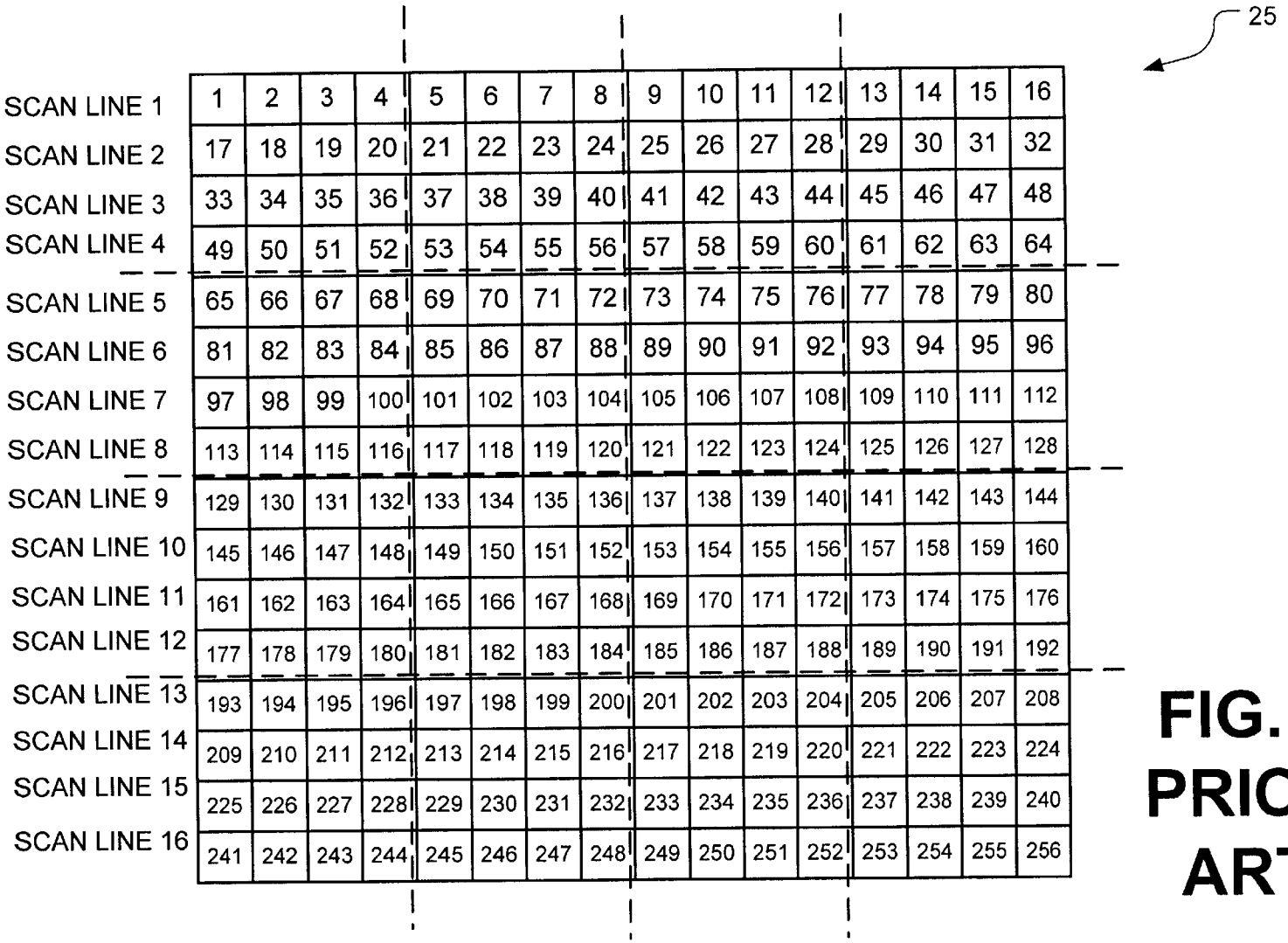
FIG. 2 is a diagram illustrating pixels, pixel regions and scan lines of an associated display 25.
Figure 3A:
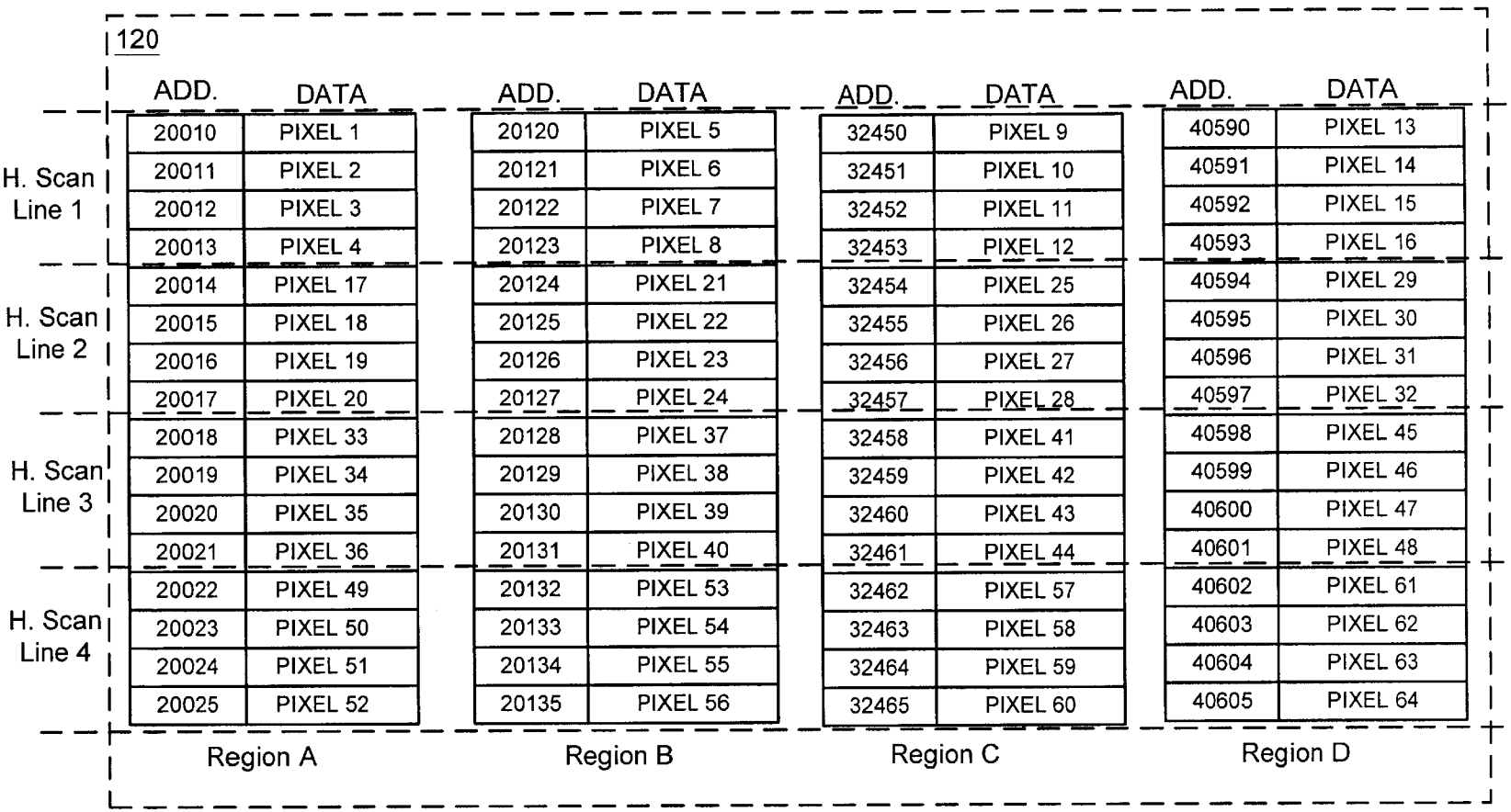
FIG. 3A PRIOR ART
FIG. 3A is a diagram illustrating allocation of sequential blocks of memory for storing pixel data corresponding to predefined pixel regions.
Figure 3B:
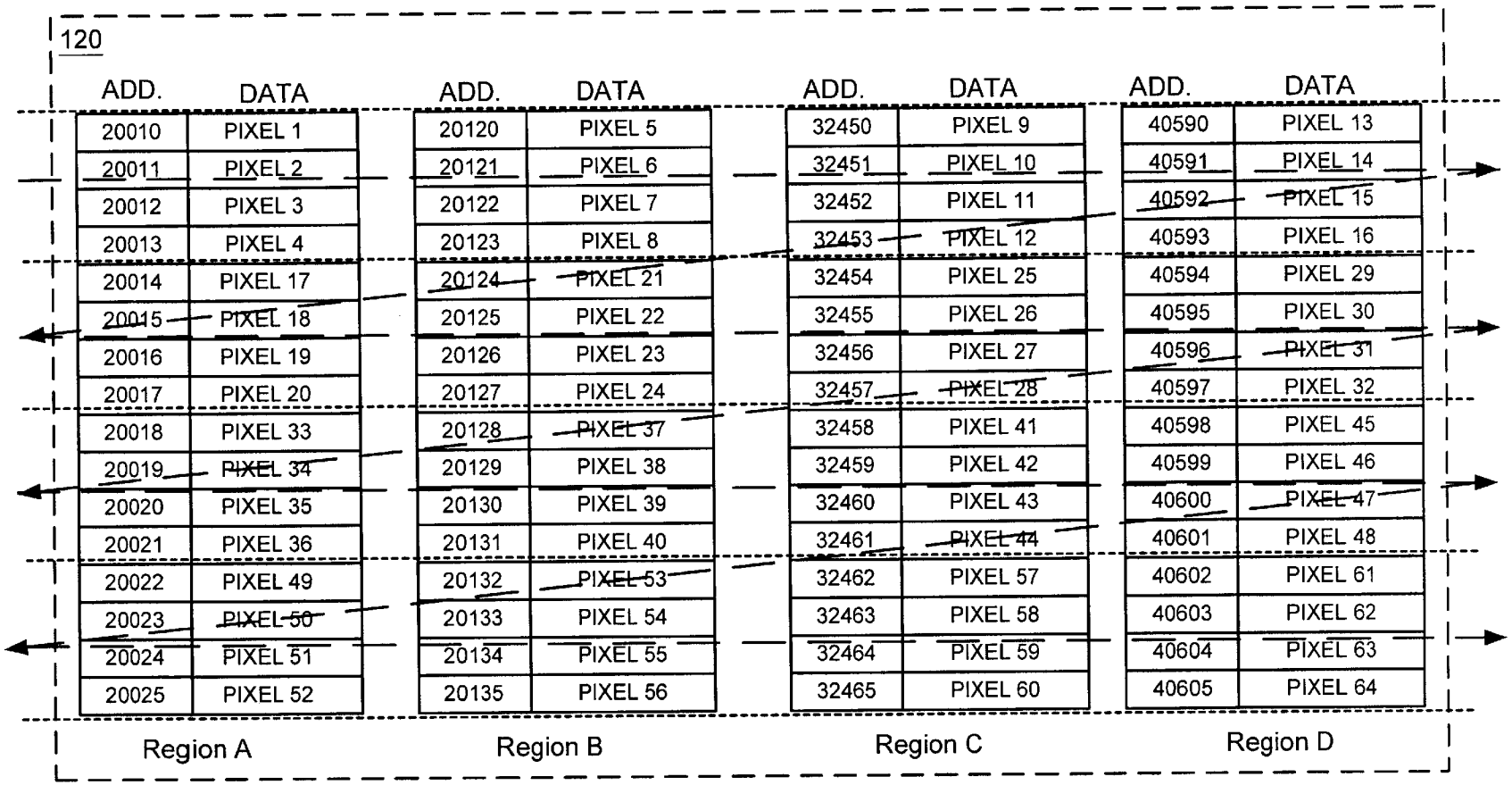
FIG. 3B PRIOR ART
FIG. 3B is a diagram further illustrating allocation of sequential blocks of memory for storing pixel data corresponding to predefined pixel regions and the order in which pixel data is retrieved.

While only four blocks of memory are illustrated, it will be recognized that a block of memory may be allocated for each respective horizontal scan line of an associated display device 25, thus, in the case of the associated display device 25 shown in FIG. 1, sixteen blocks of sequential memory could be allocated in order to accommodate the sixteen separate horizontal scan lines of the display 25. Composed pixel data is preferably stored to memory 495 in blocks of sequential memory addresses, each address corresponding to a pixel within a given scan line of an associated display device It can be seen in FIG. 7A that the block of sequential memory addresses 50010 through 50025 corresponds to a first horizontal scan line (H. Scan Line 1) of the display device 25. Similarly, blocks of sequential memory addresses are allocated to correspond to horizontal scan lines H. Scan Line 2. In this example, the block of sequential memory addresses corresponding to H. Scan Line 1 is allocated to store composed pixel data for the pixels 1 through 16. Similarly, the block of memory addresses corresponding to H. Scan line 2, H. Scan line 3 and H. Scan line 4 are allocated to store composed pixel data for other pixels that make up a scan line. The pixels stored in each of the above noted blocks of memory are sequential and correspond to a particular horizontal scan line of display device 25. No composed pixel data for pixel regions other than the associated pixel region is contained within any given block of sequential memory addresses.

FIG. 7B shows that memory 495 may also be allocated so that predetermined size blocks of sequential memory addresses correspond to a portion of a horizontal scan line. More particularly, FIG. 7B illustrates an example wherein a horizontal scan line on an associated display is greater than 16 pixels horizontally, for example, 64 pixels. In this case, a block of sequential memory addresses is allocated for every 16 pixels (one quarter of the total scan line) of the horizontal scan line of the associated display 25. The block of sequential memory addresses 50010 through 50025 corresponds to the first quarter of the first horizontal scan line (H. Scan Line 1 ($1^{st}$ Quarter)) of the display device 25. Further, the block of sequential memory addresses 50120 through 50135 corresponds to the second quarter of the horizontal scan line (H. Scan Line 1 ($2^{nd}$ Quarter)), the block of sequential memory addresses 60590 through 60605 corresponds to the third quarter of the horizontal scan line (H. Scan Line 1 ($3^{rd}$ Quarter)), while block of sequential memory addresses 62450 through 62465 corresponds to the fourth quarter of horizontal scan line 1 (H. Scan Line 1 ($4^{th}$ quarter)).

The block of memory associated with H. Scan Line 1 ($1^{st}$ Quarter) is allocated to store pixel data for the pixels 1 through 16. Similarly, the block of memory addresses corresponding to horizontal scan line 1 ($2^{nd}$ Quarter) is allocated to store pixel data for the pixels 17 through 32. The block of memory addresses corresponding to horizontal scan line 1 ($3^{rd}$ Quarter) is allocated to store pixel data for the pixels 33 through 48 while the block of memory addresses corresponding to horizontal scan line 1 ($4^{th}$ Quarter) is allocated to store pixel data for the pixels 49 through 64. As can be seen, the pixels stored in each of the above noted blocks of memory are sequential and correspond to the horizontal scan line 1 of an associated display device 25. Composed pixel data will be retrieved by blocks in sequential order so that the composed pixel data corresponding to Horizontal Scan Line 1 ($1^{st}$ Quarter) will be retrieved first and output, then the composed pixel data corresponding horizontal scan line 1 ($2^{nd}$ Quarter), then for horizontal scan line 1 (3rd Quarter) and then horizontal scan line 1 (4th Quarter). This order of retrieval is generally illustrated by the dotted lines shown in FIG. 7B. In this way, the efficiency of retrieval and output of composed pixel data for display is very high as all data retrieved from a given block of sequential memory is relevant to the scan line currently being displayed. Further, it is not necessary to cache composed pixel data temporarily to allow for assembling of all composed pixel data relevant to a particular scan line.

With reference to FIG. 6 and FIG. 7A, it will be recognized that there does not have to be a one to one correlation between pixel data stored to a block of sequential memory as shown in FIG. 6 and composed pixel data generated based upon the pixel data stored for a given pixel region as shown in FIG. 7A. More particularly, it is possible to generate pixel data for a single pixel corresponding to a scan line of an associated display device based upon non-composed pixel data representing multiple pixels. For example, operations such as super-sampling may be conducted on pixel data stored to memory. In this case, multiple pixels may be sampled to yield pixel data representing a single pixel. The resulting single pixel may correspond, for example, to a scan line of an associated display device. Such operations may be carried out as a part of a composition of data process, or prior to the composition of data process.

Further, as noted above blocks of sequential memory addresses are allocated to store pixel data representing surface areas necessary for composition. These surface areas may include, for example, front, back, left, right, overlay and attribute surfaces. Pixel data stored in blocks of sequential memory will typically be retrieved and used during composition operations. Other types of surface data not necessarily needed for operations such as composition may also be stored into blocks of sequential memory. Some examples of surfaces not necessary for operations such as composition may include depth, stencil and alpha surfaces. Memory addresses used to store surface data necessary for composition as well as surface data not necessary for composition may be located within the same physical memory device or across multiple separate and distinct memory devices.

In another embodiment, the controller of the present invention is configured to store pixel data into sequential blocks of memory, along with check bit data associated with the pixel data to indicate whether or not the pixel data stored in the particular block of sequential memory addresses has changed since a prior data refresh cycle. Check bit data may be stored in one or more predetermined blocks of sequential memory addresses. This check bit data can be used to determine whether or not pixel data stored in a particular block of sequential memory should be retrieved for composition. The resulting composed pixel data will then be stored back into memory as composed pixel data. If the pixel data has not changed since the last refresh cycle, there is no need to recompose this pixel data, as the composed pixel data resulting from the prior data retrieval or composition operation will be the same as the currently stored composed pixel data. Thus, resources can be saved by avoiding unnecessary composition operations.

Check bit data may be stored in blocks of sequential memory addresses. Each check bit may be associated with one or more pixel regions of an associated display. In other words, a single check bit may be used to indicate whether or not pixels within any one of a group of pixel regions has changed since a prior retrieval. If so, then the pixel data is retrieved from all of the pixel regions associated with the check bit, composed and stored as composed data into sequential blocks of memory. Further, the check bit is cleared. Otherwise, if the check bit indicates no changes within the group of pixel regions, the data will not be retrieved and recomposed.

Figure 8A:
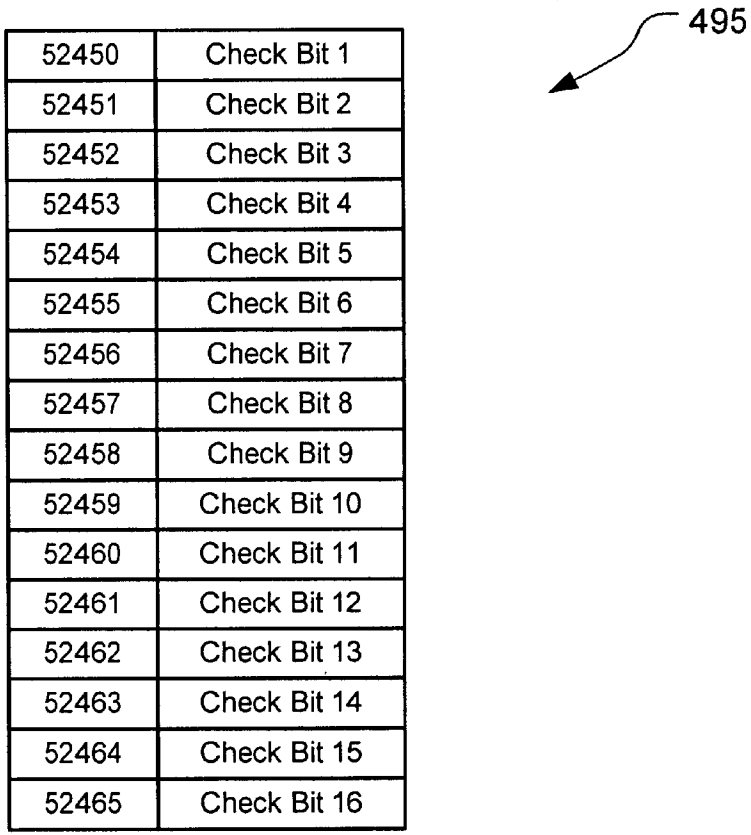
FIG. 8A is a block diagram illustrating an embodiment of a block of sequential memory addresses designated to store check bit data.

FIG. 8A illustrates a predetermined block of sequential memory addresses on memory 495 that is used to store check bit data. Here, a block of sequential memory addresses 52450–52465 are designated to store check bit data, check bit 1 through check bit 16, respectively. Each check bit may be, for example, a multi-bit data word. Each check bit may be associated with one or more pixel regions. Further, multi-bit data word may be used to store multiple check bits, thereby further relieving any burden on the memory system. Before pixel data is retrieved for composition of a particular pixel region, check bit data associated with a particular pixel region may be read to determine if any data within that pixel region has changed since last refresh cycle.

Figure 8B:
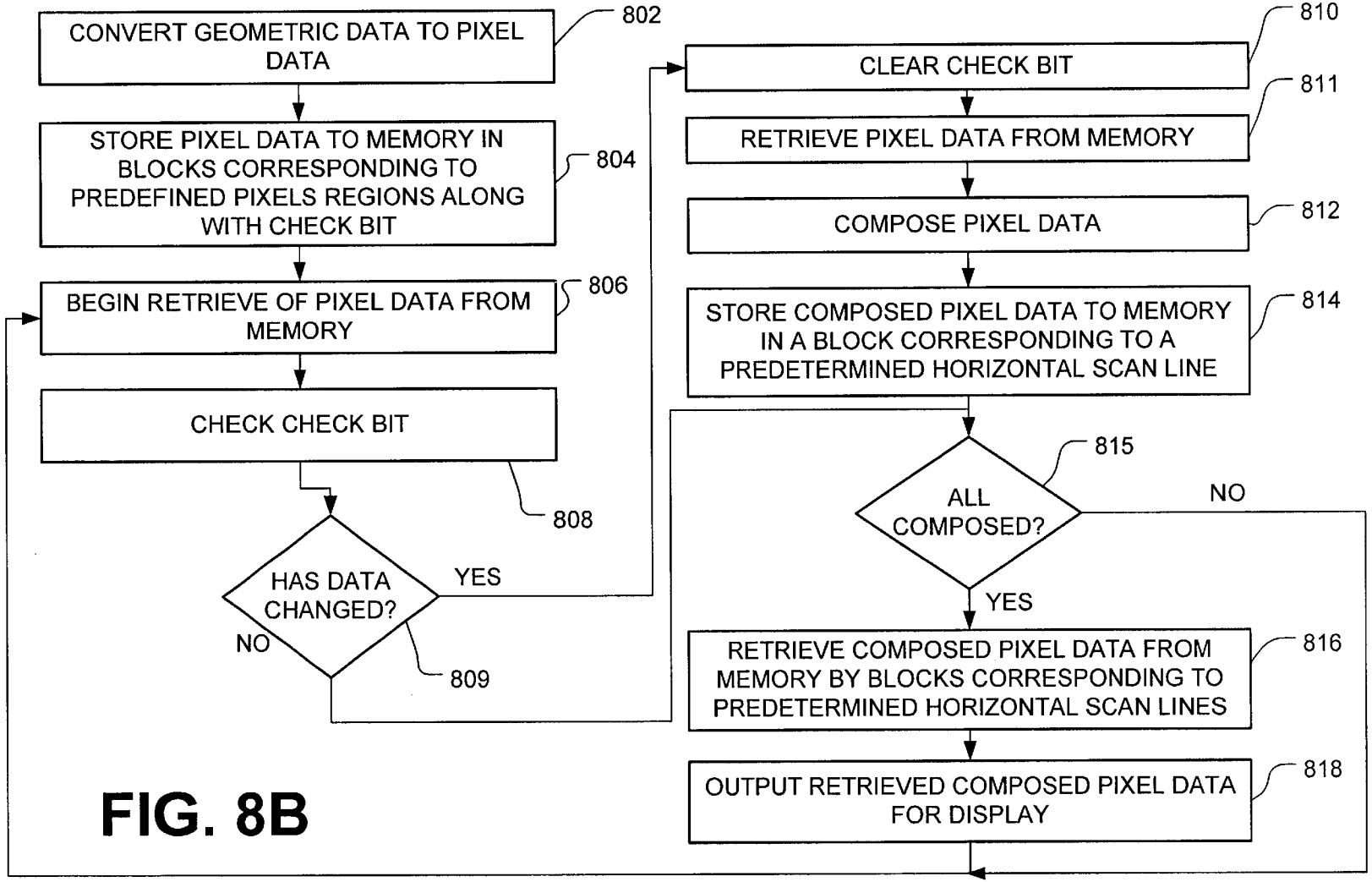
FIG. 8B is a flowchart illustrating a further embodiment aspect of the process carried out by the present invention.

FIG. 8B shows a flowchart illustrating how check bit data can be associated with a pixel region and used to avoid unnecessary processing operations. Geometric data is converted into pixel data (802) representing a predetermined surface or object to be displayed. The pixel data is stored into memory in blocks of sequential memory addresses. Check bit data associated with the pixel data is stored into one or more predetermined blocks of sequential memory addresses. This check bit data indicates whether the associated pixel data has been changed since the last refresh cycle (804). Each of these blocks of memory corresponds to a predefined pixel region of an associated display device 25 (FIG. 1). The process of retrieving pixel data from the blocks begins (806). The check bit associated with the block of memory is checked (808). If the pixel data stored therein has changed since the previous retrieval cycle (809), the check bit is cleared (810), then the pixel data is retrieved from the block of memory (811) and composed to produce composed pixel data (812). The composed pixel data is stored into memory in predetermined blocks of sequential memory addresses (814). Each block of sequential memory addresses corresponds to a predetermined horizontal scan line of an associated display device. It is then determined whether all pixel data has been composed (815). If so, the composed pixel data is retrieved from memory (816) and output for display on an associated display device (818). Once the composed pixel data is output for display (818) the process of retrieving pixel data may begin again (806). If all pixel data has not been composed (815), the process of retrieving pixel data may begin again (806). If the pixel data has changed since the previous retrieval cycle (809), then the process advances to step 810 and progresses from there as discussed above.

The controller 590 is configured to retrieve the composed pixel data from memory 495 by block. As each block contains composed pixel data for a particular horizontal scan line to be displayed, all retrieved composed pixel data can be directed to the associated display device 25 as a stream of composed pixel data. By making use of all composed pixel data retrieved from memory, without having to discard non-relevant/un-needed pixel data, the efficiency of the graphics processing and output system is greatly increased.

In another embodiment, controller 490 may be configured to generate and store the check bit data associated with a sequential portion of a displayable surface, to memory 495 or a register capable storing check bits for a limited number of composable surfaces. Further controller 490 may be configured to read the check bit during retrieval operations and pass over those blocks of pixel data that have a check bit which indicates that the pixel data therein has not changed since the last retrieval operation.

In a further embodiment, a check bit (fill check bit) may be associated with a pixel region and used to indicate that all pixels within the pixel region are constant or the same as a specified pixel value. In other words, the fill check bit may be used to indicate that the value for each pixel within the pixel region is the same as the value of a predetermined reference pixel. This reference pixel is preferably a pixel within the particular pixel region, however it may also be a pixel within another pixel region or alternatively a value stored to memory for reference. In this way, the bandwidth required to transfer pixel data to/from memory for a given pixel region may be reduced.

Figure 9A:
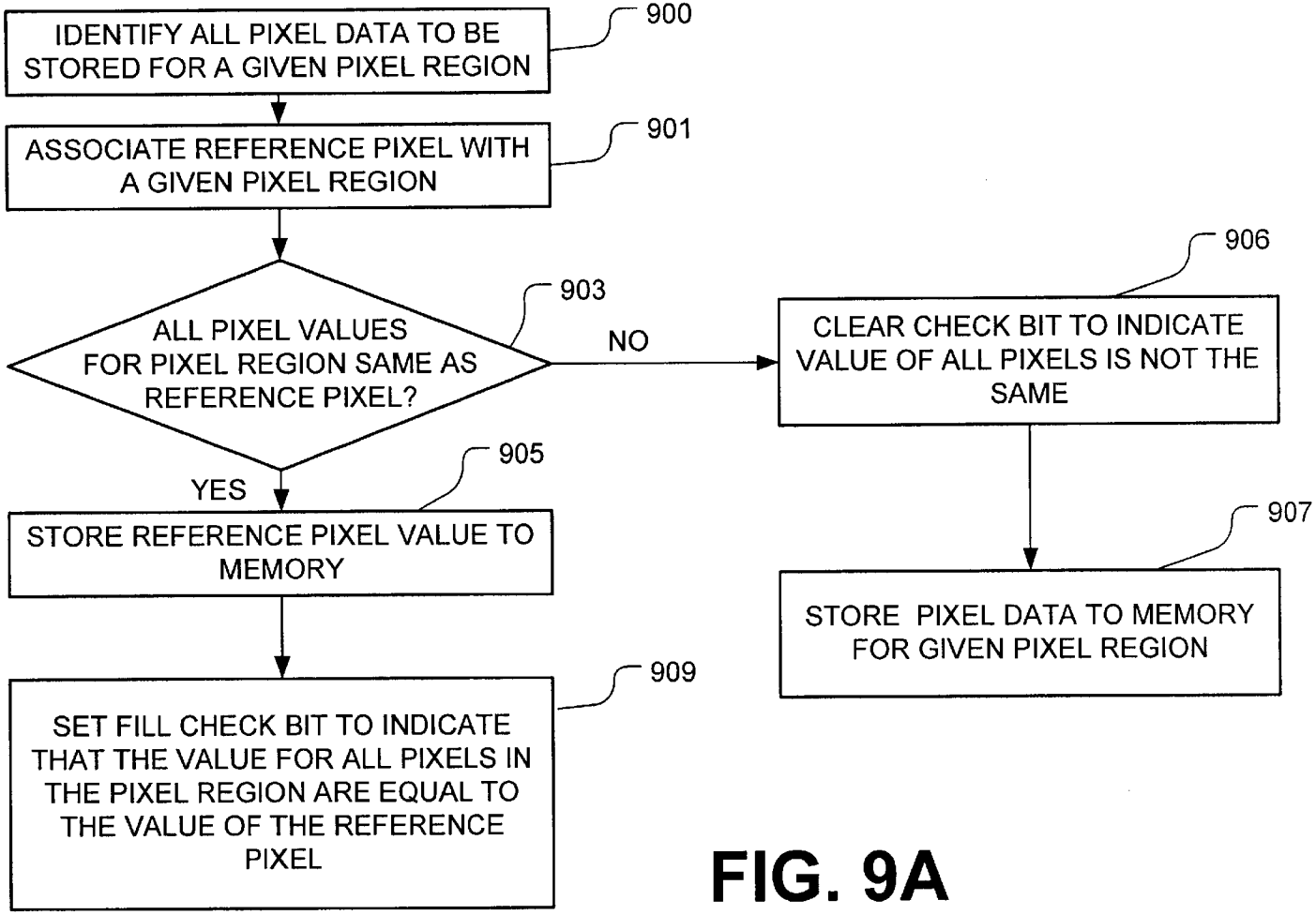
FIG. 9A is a flowchart illustrating an embodiment of the method of storing pixel data for a given pixel region according to the present invention.

FIG. 9A shows a flow chart illustrating a method of storing pixel data for a given pixel region. In this method, all pixel data to be stored for a given pixel region is identified (900). A reference pixel is associated with a given pixel region (901). This reference pixel may be a particular pixel within the pixel region of interest or a pixel located in another pixel region. For a given operation, such as a fill operation, relative to predetermined pixel data, a determination is made as to whether or not the values for all pixels within the pixel region of interest are the same as the reference pixel (903). If so, the value for the reference pixel is stored in memory (905). The data for the reference pixel may be stored, for example, in a memory address of a block of sequential memory addresses associated with the particular pixel region of interest, or in a separate block of sequential memory addresses separate and distinct from the block of sequential memory addresses associated with the pixel region of interest. Further, the reference pixel data may be stored separate from any specific block of sequential memory addresses. A fill check bit associated with the pixel region is set to indicate that the value of all pixels within the pixel region is the same as the value of the reference pixel (909). If not, the fill check bit is cleared to indicate that the value of all pixels is not the same (906) and the pixel data for each pixel within the pixel region is stored into memory associated with the pixel region (907).

Figure 9B:
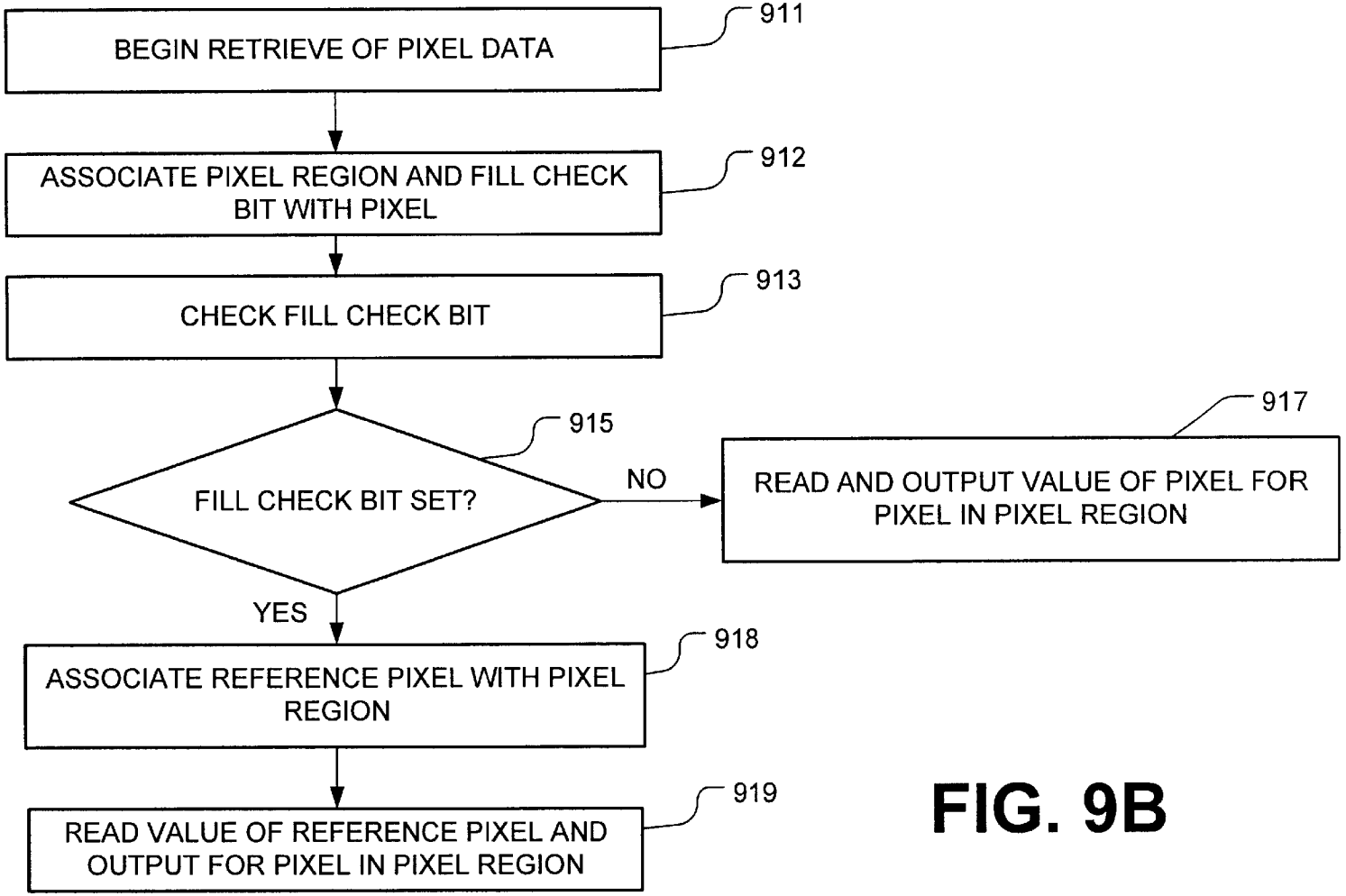
FIG. 9B is a flowchart illustrating an embodiment of the method of retrieving pixel data for a given pixel region according to the present invention.

FIG. 9B shows how pixel data for a given pixel may be retrieved, or read out of memory. In this example the process of retrieving pixel data is begun (911). A pixel region and fill check bit are associated with the pixel data (912). The fill check bit associated with the particular pixel region is checked (913) to determine if it is set (915). If not, the pixel data for the pixel within the pixel region is read out of the memory block associated with the pixel region in which pixel data is stored (917). If so, the pixel region is associated with the reference pixel (918) and the value of the reference pixel associated with the pixel region is read out and output as the value for the pixel within the pixel region (919). This avoids the need for retrieving and transferring all pixel data within the pixel region where the value of each pixel therein is the same as the value of the reference pixel.

The processor 485, controller 490 and/or CPU 460 of the present invention can be implemented in hardware, software, firmware, or a combination thereof. In the preferred embodiment(s), the processor 485 and the controller 490 are implemented in software or firmware that is stored in a memory and that is executed by a suitable instruction execution system. If implemented in hardware, as in an alternative embodiment, the processor 485, controller 490 and/or CPU 460 can implemented with any or a combination of the following technologies, which are all well known in the art: a discrete logic circuit(s) having logic gates for implementing logic functions upon data signals, an application specific integrated circuit having appropriate logic gates, a programmable gate array(s) (PGA), a fully programmable gate array (FPGA), etc. Controller 490 may be implemented as a general-purpose processor, such as, for example the Intel™ Pentium™ IV central processing unit. Further, controller 490 may be implemented as a graphics processor or a digital signal processor (DSP). Similarly, processor 485 may be implemented as a general-purpose processor, such as, for example the Intel™ Pentium™ IV central processing unit. Further, processor 485 may be implemented as a graphics processor or a digital signal processor (DSP).

The processor 485 may be configured to incorporate or otherwise carry out the functions of controller 490 and/or CPU 460. CPU 460 may also be configured to incorporate or otherwise carry out the functions of controller 490 and/or processor 485. Similarly controller 490 may be configured to incorporate or otherwise carry out the functions of CPU 560 and/or processor 485.

The software 467 comprises an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer-readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (magnetic), a read-only memory (ROM) (magnetic), an erasable programmable read-only memory (EPROM or Flash memory) (magnetic), an optical fiber (optical), and a portable compact disc read-only memory (CDROM) (optical). Note that the computer-readable medium could even be paper or another suitable medium upon which the program is printed, as the program can be electronically captured, via for instance, optical scanning of the paper or other medium, then compiled, interpreted or otherwise processed in a suitable manner if necessary, and then stored in a computer memory.

The flow charts of FIG. 5, FIG. 8B, FIG. 9A and FIG. 9B show the architecture, functionality, and operation of a possible implementation of control software that may be stored on memory 465 (FIG. 4) as software 467. In this regard, each block represents a module, segment, or portion of code, which comprises one or more executable instructions for implementing the specified logical function(s). It should also be noted that in some alternative implementations, the functions noted in the blocks may occur out of the order noted in FIG. 5, FIG. 8B, FIG. 9A or FIG. 9B. For example, two blocks shown in succession in FIG. 5, FIG. 8B, FIG. 9A or FIG. 9B may in fact be executed substantially concurrently or the blocks may sometimes be executed in the reverse order, depending upon the functionality involved, as will be further clarified herein below. It will be recognized that the functionality and operations described in FIG. 5, FIG. 8B, FIG. 9A or FIG. 9B, or portions thereof, could also be implemented in hardware via, for example, a state machine.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of the present invention and protected by the following claims.

What is claimed is:

1. A method of generating a stream of composed pixel data, said method comprising the steps of:

storing pixel data;

retrieving said pixel data;

composing said pixel data to produce composed pixel data;

identifying composed pixel data corresponding to a pixel region;

associating a reference pixel with the pixel region;

determining if pixel data for each pixel in the pixel region is the same as pixel data for the reference pixel, when pixel data for each pixel in the pixel region is the same as pixel data for the reference pixel, storing the reference pixel data and setting a check bit, otherwise, when pixel data for each pixel in the pixel region is not the same as pixel data for the reference pixel, clearing the check bit; and storing pixel data for each pixel in the pixel region.

2. The method of claim 1, wherein said step of storing pixel data comprises storing pixel data into a first memory location corresponding to a predetermined pixel region of an associated display device.

3. The method of claim 1, wherein said step of storing pixel data for each pixel in the pixel region comprises storing pixel data into a second memory location corresponding to a predetermined scan line of an associated display device.

4. A graphics system for processing pixel data associated with a predetermined pixel region comprising:

memory;

controller configured to identify pixel data associated with a predetermined pixel region that is to be stored to said memory; and said controller is further configured to associate a reference pixel with said pixel region and to store pixel data representative of said reference pixel to said memory and to set a fill check bit associated with said pixel region where the values of all pixels within said pixel region are the same as the value of said pixel data representative of said reference pixel.

5. The system of claim 4, wherein said controller is configured to store pixel data associated with a predetermined pixel region to said memory in a first block of sequential memory addresses that are associated with said predetermined pixel region.

6. The system of claim 4, wherein said pixel data comprises said reference pixel.

7. The system of claim 4, wherein said fill check bit is stored to a memory location that is associated with said first block of sequential memory addresses.

8. The system of claim 4, further comprising a processor configured to convert geometric data into said pixel data, said geometric data being representative of a surface within a scene to be displayed.

9. A system for generating a stream of composed pixel data comprising:

a memory; and a controller communicatively coupled to said memory, said controller configured to identify a pixel region, associate a reference pixel with the pixel region, store pixel data representative of said reference pixel to said memory and set a fill check bit associated with the pixel region when the values of all pixels within said pixel region are the same as the value of the pixel data representative of said reference pixel.

10. The system of claim 9, wherein said controller is further configured to compose pixel data corresponding to the pixel region in response to the fill check bit.

11. The system of claim 10, wherein said controller is further configured to retrieve and forward the composed pixel data to an image renderer.

12. The system of claim 9, further comprising a processor configured to convert geometric data into said pixel data, said geometric data being representative of a surface within a scene to be displayed.

13. The system of claim 12, wherein said controller is configured to carry out the functions of said processor.

14. The system of claim 9, wherein said pixel region corresponds to a predetermined number of pixels on a display device.

15. The system of claim 11, wherein a block of sequential memory addresses corresponds to a scan line of said image renderer.

16. The system of claim 11, wherein a block of sequential memory addresses corresponds to a portion of a scan line of said image renderer.

17. The system of claim 11, wherein a block of sequential memory addresses corresponds to a plurality of scan line of said image renderer.

18. The system of claim 11, wherein a block of memory addresses comprises 8-bit memory locations.

19. A method for processing image data comprising:

converting geometric data to pixel data;

storing the pixel data in blocks corresponding to predetermined pixel regions;

associating a check bit with each predetermined pixel region;

identifying a reference pixel selected from a pixel within each of the predetermined pixel regions; and setting the check bit when each pixel in a select one of the predetermined pixel regions shares the same pixel data with the reference pixel for the respective pixel region.

20. The method of claim 19, further comprising:

retrieving the check bit, when the check bit is set;

composing the reference pixel for the respective pixel region, otherwise when the check bit is not set, composing pixel data for each pixel in the respective pixel region.

21. The method of claim 20, further comprising:

determining if pixel data has changed, when pixel data has not changed;

retrieving composed pixel data corresponding to scan lines; and forwarding the composed pixel data.

22. The method of claim 20, further comprising:

determining if pixel data has changed, when pixel data has changed;

resetting the check bit;

composing the pixel data; and storing composed pixel data corresponding to a scan line.

23. The method of claim 22, further comprising:

determining if all pixel data has been composed, when all pixel data has not been composed, repeating the storing, associating, identifying, setting, retrieving the check bit, composing, determining, resetting the check bit, and composing steps.

24. The method of claim 22, further comprising:

determining if all pixel data has been composed, when all pixel data has been composed, retrieving composed pixel data corresponding to scan lines; and forwarding the composed pixel data.

25. A method for processing composed image data comprising:

retrieving composed image data; and determining if a check bit is set, when it is determined that the check bit is set, associating a reference pixel with a pixel region and applying reference pixel data to each pixel corresponding to the pixel region; otherwise, applying pixel data corresponding to each pixel in the pixel region.

* * * * *